US008998565B2

(12) United States Patent
Foster et al.

(10) Patent No.: US 8,998,565 B2
(45) Date of Patent: Apr. 7, 2015

(54) APPARATUS TO SEAL WITH A TURBINE BLADE STAGE IN A GAS TURBINE

(75) Inventors: Gregory Thomas Foster, Greer, SC (US); Andres Jose Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1024 days.

(21) Appl. No.: 13/088,635

(22) Filed: Apr. 18, 2011

(65) Prior Publication Data

US 2012/0260670 A1 Oct. 18, 2012

(51) Int. Cl.
*F01D 25/24* (2006.01)
*F01D 11/08* (2006.01)

(52) U.S. Cl.
CPC ..... *F01D 25/246* (2013.01); *F01D 11/08* (2013.01)

(58) Field of Classification Search
CPC ..... F01D 25/24; F01D 25/243; F01D 25/246; F01D 25/14; F01D 25/145; F01D 25/265; F01D 11/00; F01D 11/001; F01D 11/08
USPC ..... 415/170.1, 173.1, 173.3, 182.1, 196, 415/213.1, 214.1
See application file for complete search history.

(56) References Cited

U.S. PATENT DOCUMENTS

| | | | | |
|---|---|---|---|---|
| 3,656,862 | A * | 4/1972 | Rahaim et al. | 415/173.2 |
| 4,247,248 | A * | 1/1981 | Chaplin et al. | 415/136 |
| 4,337,016 | A * | 6/1982 | Chaplin | 415/116 |
| 4,529,355 | A * | 7/1985 | Wilkinson | 415/173.1 |
| 5,080,557 | A | 1/1992 | Berger | |
| 5,964,575 | A * | 10/1999 | Marey | 415/115 |
| 6,758,653 | B2 | 7/2004 | Morrison | |
| 6,821,085 | B2 * | 11/2004 | Darkins et al. | 415/173.1 |
| 6,877,952 | B2 * | 4/2005 | Wilson | 415/136 |
| 2004/0071548 | A1 * | 4/2004 | Wilson, Jr. | 415/173.1 |
| 2005/0158168 | A1 * | 7/2005 | Bruce et al. | 415/173.1 |
| 2005/0254942 | A1 | 11/2005 | Morrison et al. | |
| 2006/0078429 | A1 | 4/2006 | Darkins, Jr. et al. | |
| 2007/0031258 | A1 | 2/2007 | Campbell et al. | |
| 2007/0280820 | A1 | 12/2007 | Roberts et al. | |
| 2008/0087021 | A1 | 4/2008 | Radonovich et al. | |
| 2008/0178465 | A1 | 7/2008 | Schiavo et al. | |
| 2008/0206046 | A1 | 8/2008 | Razzell et al. | |
| 2009/0010755 | A1 | 1/2009 | Keller et al. | |

* cited by examiner

*Primary Examiner* — Nathaniel Wiehe
*Assistant Examiner* — Eldon Brockman
(74) *Attorney, Agent, or Firm* — Cantor Colburn LLP

(57) ABSTRACT

Disclosed is an apparatus configured to seal with a turbine blade stage of a gas turbine. The apparatus includes an outer shroud coupled to an inner shroud and configured to circumferentially surround the turbine blade stage. The inner shroud is configured to circumferentially surround the turbine blade stage to seal with the turbine blade stage and includes an attachment element configured to be inserted into the outer shroud to couple the inner shroud to the outer shroud.

11 Claims, 5 Drawing Sheets

APPARATUS TO SEAL WITH A TURBINE BLADE STAGE IN A GAS TURBINE

BACKGROUND OF THE INVENTION

The subject matter disclosed herein relates to gas turbines and, in particular, to improving the efficiency thereof.

Gas turbines are well known as prime movers in the power generation industry. As fuel prices continue to spiral upwards, new designs of gas turbines are sought after to improve their efficiency.

In gas turbine engines, rotating turbine blades in the hot turbine section seal radially towards a set of high temperature parts called shrouds. These shrouds form an annulus cavity in which the rotating turbine blades function. The annulus cavity forms a seal close to but not in contact to the turbine blades in order to prevent hot gases from the combustion section of the gas turbine from escaping around the turbine blades. In prior art gas turbines, these shrouds and/or their supporting attachments have to be force cooled usually by forced air cooling. Cooling the prior art shroud adds to the parasitic losses of the gas turbine system, thus, lowering the overall efficiency of the prior art gas turbine system. Hence, it would be well received in the power industry if the parasitic losses could be reduced in gas turbine systems in order to increase their efficiency.

BRIEF DESCRIPTION OF THE INVENTION

According to one aspect of the invention, an apparatus is disclosed that is configured to seal with a turbine blade stage of a gas turbine. The apparatus includes an outer shroud coupled to an inner shroud and configured to circumferentially surround the turbine blade stage. The inner shroud is configured to circumferentially surround the turbine blade stage to seal with the turbine blade stage and includes an attachment element configured to be inserted into the outer shroud to couple the inner shroud to the outer shroud.

According to another aspect of the invention, a gas turbine is disclosed that includes a compressor section configured to compress intake air, a combustion section configured to combust compressed intake air and fuel, and a turbine section comprising a turbine blade stage configured to rotate upon impingement of hot gas from the combustion section. An outer shroud is configured to circumferentially surround the turbine blade stage and to be coupled to an inner shroud. The inner shroud is configured to circumferentially surround the turbine blade stage to seal with the turbine blade stage and includes an attachment element configured to be inserted into the outer shroud to couple the inner shroud to the outer shroud.

According to yet another aspect of the invention, a gas turbine system is disclosed that includes a gas turbine coupled to a load. The gas turbine includes a turbine blade stage, an outer shroud configured to circumferentially surround the turbine blade stage, and an inner shroud configured to circumferentially surround the turbine blade stage to seal with the turbine blade stage and includes an attachment element configured to be inserted into the outer shroud to couple the inner shroud to the outer shroud. A casing included with the gas turbine system is configured to be coupled to the outer shroud and to at least partially enclose the gas turbine. A purge system included with the gas turbine system is configured to purge one or more cavities formed by the outer shroud and the inner shroud with purge gas that purges an interior of the casing.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings, wherein like elements are numbered alike, in which:

The detailed description explains embodiments of the invention, together with advantages and features, by way of example and not limitation with reference to the drawings.

DETAILED DESCRIPTION OF THE INVENTION

Figure 1:
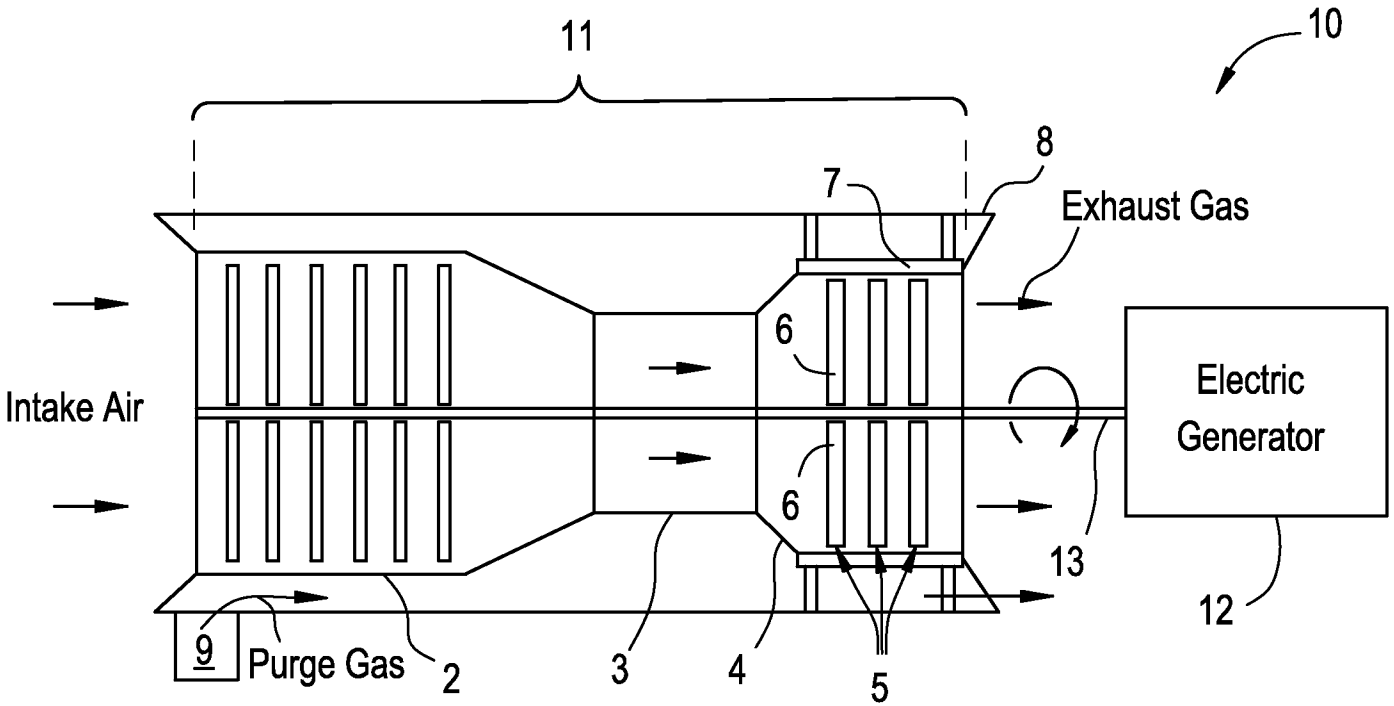
FIG. 1 illustrates a cross-sectional view of an exemplary embodiment of a gas turbine system.

FIG. 1 illustrates an exemplary embodiment of a gas turbine system 10. The gas turbine system 10 includes a gas turbine 11 coupled to an electric generator 12 via a shaft 13. The electric generator 12 represents any load that may be powered by the gas turbine 11, such as a blade load for aviation or a mechanical drive. The gas turbine 11 includes a compressor section 2 configured to compress intake air, a combustion section 3 configured to combust the compressed intake air and fuel, and a turbine section 4 configured to convert hot gases from the combustion section 3 into rotational energy. The turbine section 4 includes turbine blade stages 5 where each stage 5 has a plurality of turbine blades 6 extending radially from the shaft 13. Circumferentially surrounding each turbine stage 5 is a shroud assembly 7 coupled to a turbine casing 8. An interior of the turbine casing 8 is generally bathed in cool air used for purging cavities within the casing 8. A purging system 9 purges the casing 8 with a cool gas such as air.

Figure 2:
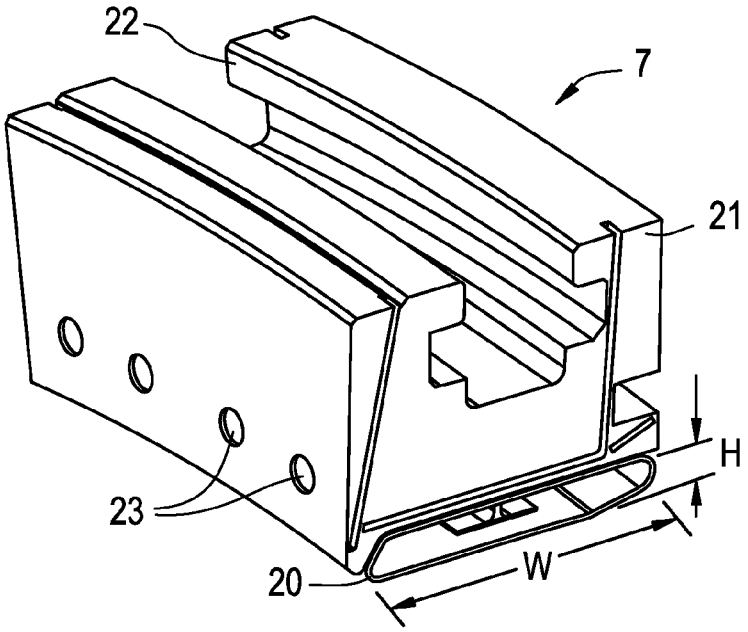
FIG. 2 illustrates a three-dimensional view of a shroud assembly having an outer shroud and an inner shroud.
Figure 3:
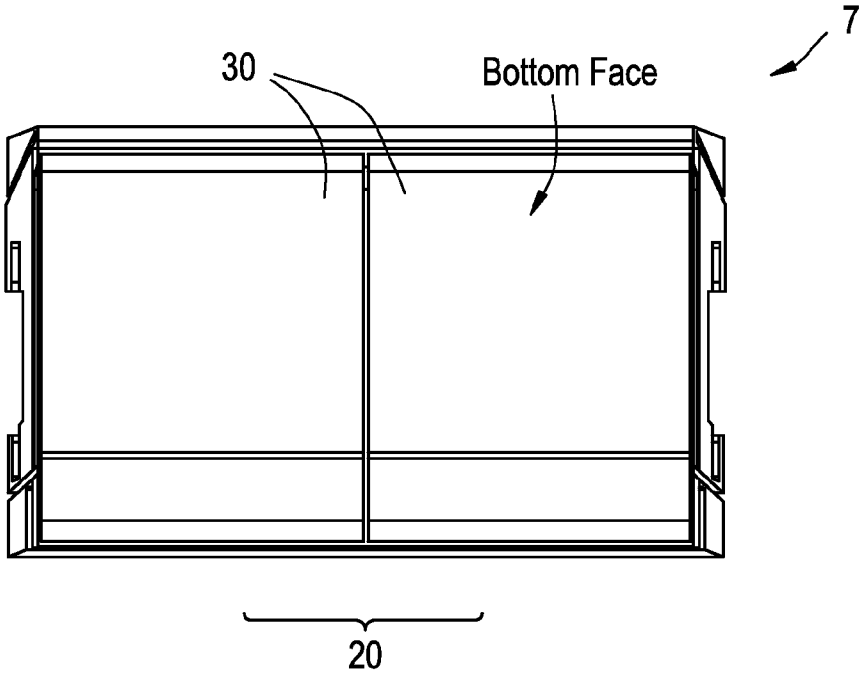
FIG. 3 illustrates a bottom view of the shroud assembly.

Reference may now be had to FIG. 2, which illustrates a cross-sectional three-dimensional (3D) view of the shroud assembly 7 having an outer shroud 21 and an inner shroud 20. The outer shroud 21 is coupled to the casing 8 via a groove 22. The inner shroud 20 is attached to the outer shroud 21 using a plurality of attachment pins 23. Material used to make the inner shroud 20 can withstand the high operating temperatures in the turbine section 4 without the need for forced cooling. Non-limiting embodiments of materials used to make the inner shroud 20 include ceramic matrix composite materials and refractory alloys. The inner shroud 20 defines a void internal to the inner shroud 20. The void has a width W and a height H. A cross-section of the inner shroud 20 in the embodiment of FIG. 2 has a generally rectangular hollow shape with a bottom face facing the flow path of hot gas in the turbine section 4, while an upper face of the rectangular shape faces the outer shroud 21 and the turbine casing 8. One advantage of the void in the inner shroud 20 is that the void limits heat transfer from the bottom face to the upper face of the inner shroud 20. It can be appreciated that the outer shroud 21 can be made from a plurality of segments. One segment is shown in FIG. 2. FIG. 3 illustrates a bottom view of the shroud assembly 7 where the inner shroud 20 includes a plurality of inner shroud sections 30, which make up the inner shroud 20. The view in FIG. 3 shows the bottom face of each inner shroud section 30.

Figure 4:
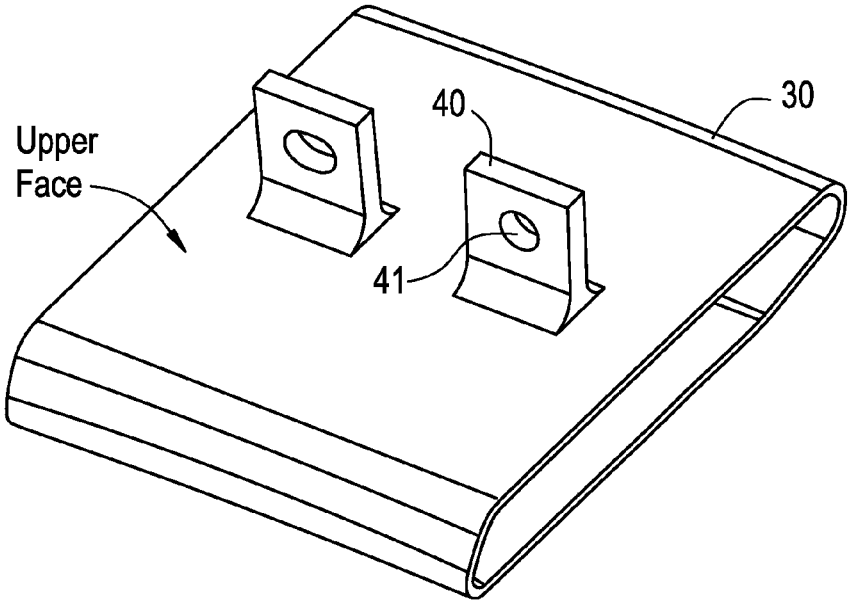
FIG. 4 illustrates a three-dimensional view of the inner shroud.

FIG. 4 illustrates a three-dimensional view of one inner shroud section 30. The view in FIG. 4 shows the upper face of one inner shroud section 30. Each inner shroud section 30 includes one or more attachment flanges 40, which are configured to be inserted and attached inside the outer shroud 21. Each flange 40 in the embodiment of FIG. 4 includes a hole 41 configured to accept the pin 23 for attachment. The outer shroud 21 includes an opening configured to receive each attachment flange 40. Because the outer shroud 21 is cooler than the inner shroud 20, the attachment flanges 40 and the pins 23 are at a temperature lower than the temperature of the portion of the inner shroud 20 forming the void and, thus, do not require cooling.

Figure 5:
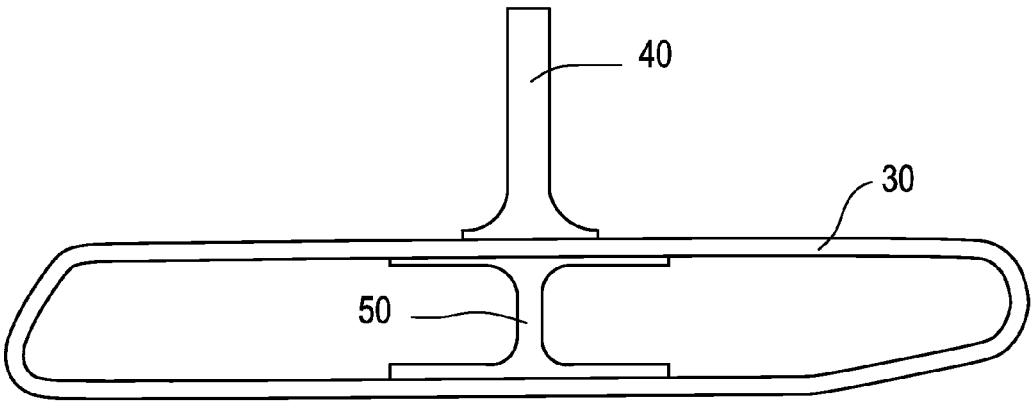
FIG. 5 illustrates a side view of the inner shroud.

FIG. 5 illustrates a side view of one inner shroud section 30. Disposed inside the inner shroud section 30 is a rib 50. The rib 50 is configured to increase the rigidity of the inner shroud section 30.

Figure 6:
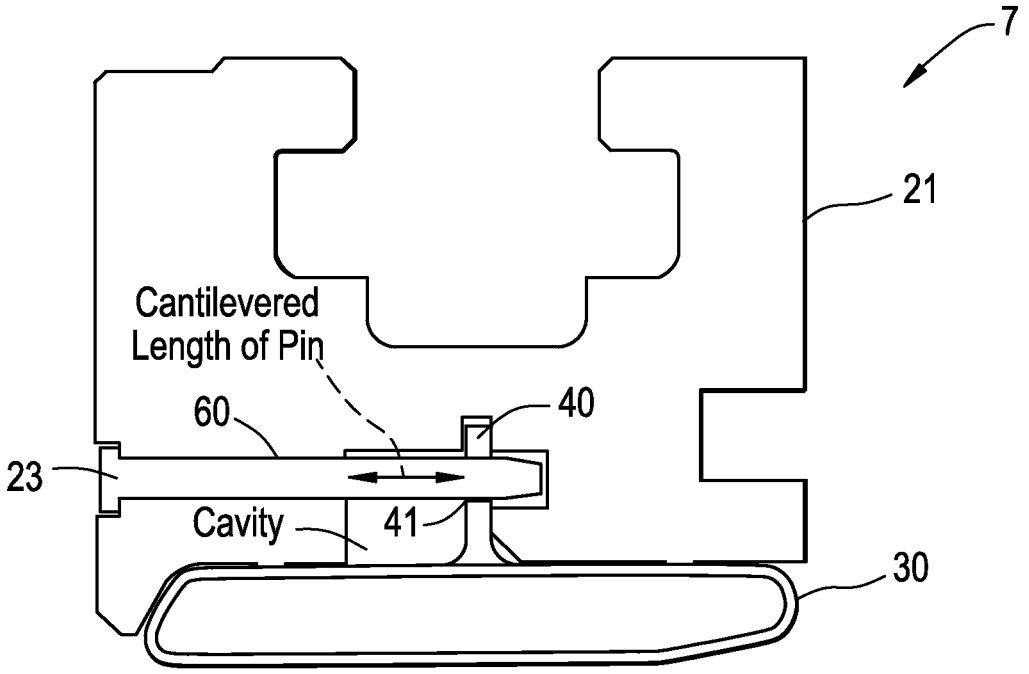
FIG. 6 depicts aspects of details for attaching the inner shroud to the outer shroud using a first attachment method.

FIG. 6 illustrates a side view of one inner shroud section 30 attached to the outer shroud 21. A pin 23 secures the inner shroud section 30 to the outer shroud 21 through the hole 41 in the attachment flange 40 and a hole 60 in the outer shroud 21 when the holes 41 and 60 are in alignment. In one embodiment, during alignment, the holes 41 and 60 are offset so that the pin 23 is elastically deformed to force the inner shroud section 30 to be pressed against the outer shroud 21. This design sizes the cantilevered length of the pin 23 so that the pin 23 deforms elastically to force the inner shroud section 30 to be in contact with the outer shroud 21 thereby reducing stress in the inner shroud section 30. FIG. 6 also illustrates one example of a cavity formed in the shroud assembly 7. This cavity and, thus, the attachment flange 40 and the pin 23 are bathed in the cool air used for purging activities within the casing 8. It can be appreciated that this cavity provides another example of an attachment scheme that does not require forced air cooling from a dedicating forced air cooling source.

Figure 7:
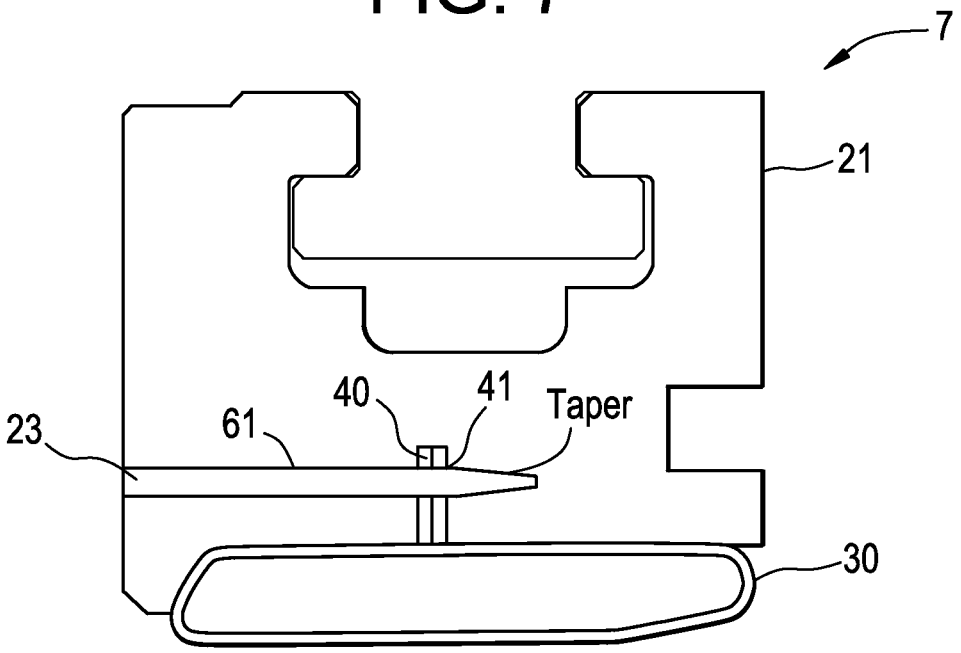
FIG. 7 depicts aspects of details for attaching the inner shroud to the outer shroud using a second attachment method.

FIG. 7 illustrates an alternate way to secure the inner shroud section 30 to the outer shroud 21. In the embodiment of FIG. 7, the pin 23 includes a taper configured to force the inner shroud section 30 against the outer shroud 21 when the pin 23 is inserted into the holes 41 and 60. This design deforms the inner shroud section 30 to maintain contact with the outer shroud 21, but can also add stress to the inner shroud section 30.

Figure 8:
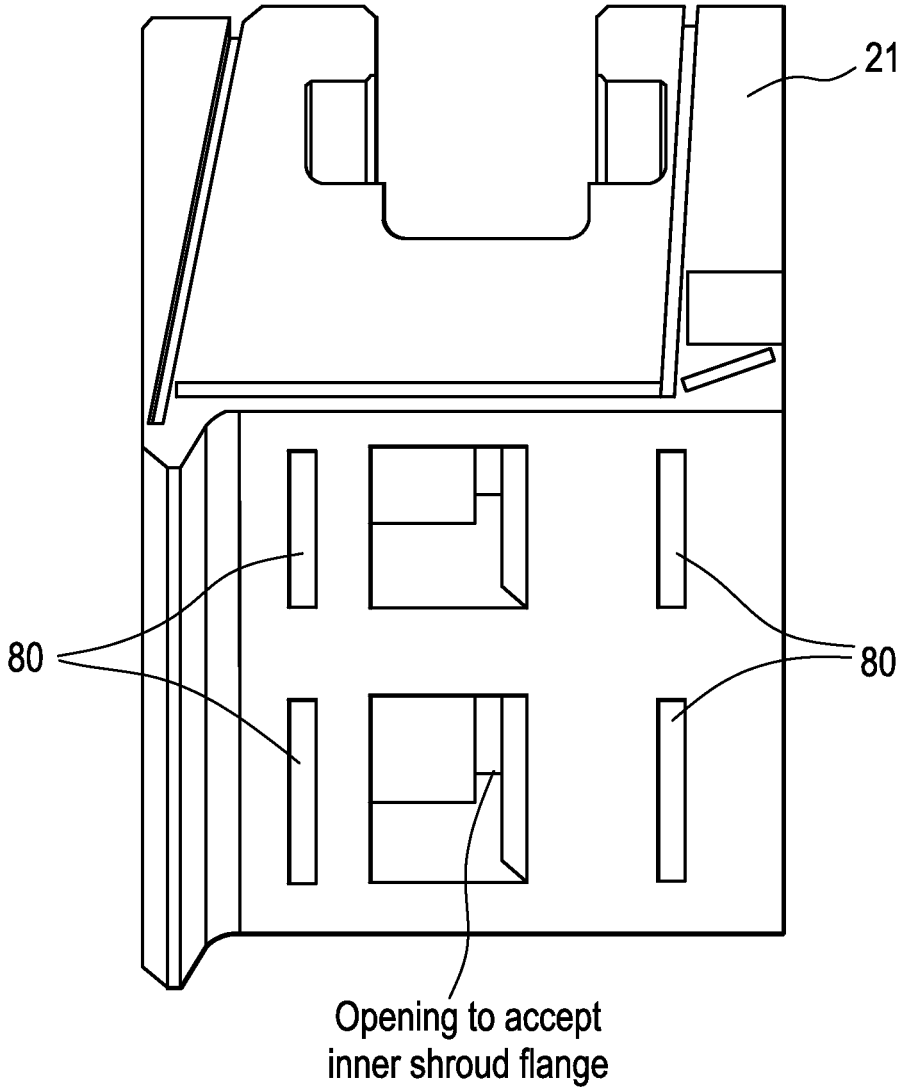
FIG. 8 illustrates a three dimensional view of an underside of the outer shroud depicting pads for contacting the inner shroud.

FIG. 8 illustrates a 3D bottom view of the outer shroud 21. In the embodiment of FIG. 8, the outer shroud includes contact pads 80 configured to contact the inner shroud section 30 when the inner shroud section 30 is attached to and pressed against the outer shroud 21. One advantage of the contact pads 80 is that force resulting from the attachment can be directed to areas of the outer shroud 21 that are known to be strong enough to accept these forces without breaking or deforming Another advantage of the contact pads 80 is a space between the inner shroud section 30 and the outer shroud 21 is formed surrounding the contact pads 80. This space acts as a heat insulator to limit heat transfer from the inner shroud section 30 to the outer shroud 21, thereby, keeping the temperature of the outer shroud 21 less than the temperature of the inner shroud section 30.

It can be appreciated that the exemplary embodiments disclosed herein allow for decreasing parasitic losses in a gas turbine system due to operation of auxiliary equipment and, thereby, increase the overall efficiency of the gas turbine system.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to one component being coupled either directly to another component or indirectly to the another component via one or more intermediate components.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus configured to seal with a turbine blade stage of a gas turbine, the apparatus comprising:

a casing that at least partially encloses the gas turbine;

an outer shroud configured to be coupled to the casing and circumferentially surround the turbine blade stage; and an inner shroud configured to circumferentially surround the turbine blade stage to seal with the turbine blade stage and comprising an attachment element configured to be inserted into the outer shroud to couple the inner shroud to the outer shroud, the inner shroud defining a void internal to the inner shroud;

wherein the outer shroud and the inner shroud form a cavity that is in fluid communication with a purge gas supply attached to the casing and supplying cool gas such that the cavity is cooled by the cool gas purging the casing, the cavity being in communication with the attachment element.

2. The apparatus according to claim 1, wherein a width of the void is greater than a height of the void.

3. The apparatus according to claim 1, wherein the inner shroud comprises a rib disposed in the void and configured to increase the rigidity of the inner shroud.

4. The apparatus according to claim 1, wherein the outer shroud comprises one or more contact pads configured to contact the inner shroud when the inner shroud is coupled to the outer shroud.

5. The apparatus according to claim 1, wherein the inner shroud comprises a plurality of inner shroud sections, each inner shroud section being configured to be disposed adjacent to another inner shroud section with each inner shroud section circumferentially surrounding a portion of the turbine blade stage.

6. The apparatus according to claim 1, wherein the inner shroud is made of at least one of ceramic matrix composite material or a refractory alloy configured to withstand an operating temperature in the turbine blade stage.

7. An apparatus configured to seal with a turbine blade stage of a gas turbine, the apparatus comprising:

a casing that at least partially encloses the gas turbine;

an outer shroud configured to be coupled to the casing and circumferentially surround the turbine blade stage:, an inner shroud configured to circumferentially surround the turbine blade stage to seal with the turbine blade stage and comprising an attachment element configured to be inserted into the outer shroud to couple the inner shroud to the outer shroud, the attachment element comprising a flange defining a hole therein;

wherein the outer shroud and the inner shroud form a cavity that is in fluid communication with a purge gas supply attached to the casing and supplying cool gas such that the cavity is cooled by the cool gas purging the casing, the cavity being in communication with the attachment element, the outer shroud defining a hole that is configured to be in alignment with the hole defined by the flange when the inner shroud is inserted into the outer shroud;

a pin configured to be inserted into the hole defined by the outer shroud and the hole defined by the inner shroud, wherein alignment comprises the hole defined by the outer shroud being offset an amount from the hole defined by the flange such that when the pin is inserted, the pin is elastically deformed to keep the inner shroud pressing against the outer shroud.

8. An apparatus configured to seal with a turbine blade stage of a gas turbine, the apparatus comprising:

a casing that at least partially encloses the gas turbine;

an outer shroud configured to be coupled to the casing and circumferentially surround the turbine blade stage:, an inner shroud configured to circumferentially surround the turbine blade stage to seal with the turbine blade stage and comprising an attachment element configured to be inserted into the outer shroud to couple the inner shroud to the outer shroud, the attachment element comprising a flange defining a hole therein;

wherein the outer shroud and the inner shroud form a cavity that is in fluid communication with a purge gas supply attached to the casing and supplying cool gas such that the cavity is cooled by the cool gas purging the casing, the cavity being in communication with the attachment element, the outer shroud defining a hole that is configured to be in alignment with the hole defined by the flange when the inner shroud is inserted into the outer shroud;

a pin configured to be inserted into the hole defined by the outer shroud and the hole defined by the inner shroud, wherein the pin comprises a taper configured to press the inner shroud against the outer shroud when the pin is inserted into the hole defined by the outer shroud and the hole defined by the flange.

9. A gas turbine comprising:

a compressor section configured to compress intake air;

a combustion section configured to combust compressed intake air and fuel;

a turbine section comprising a turbine blade stage configured to rotate upon impingement of hot gas from the combustion section;

a casing that at least partially encloses the gas turbine;

an outer shroud configured to be coupled to the casing and circumferentially surround the turbine blade stage;

an inner shroud configured to circumferentially surround the turbine blade stage to seal with the turbine blade stage and comprising an attachment element configured to be inserted into the outer shroud to couple the inner shroud to the outer shroud, the inner shroud defining a void internal to the inner shroud; and wherein the outer shroud and the inner shroud form a cavity that is in fluid communication with a purge gas supply attached to the casing and supplying cool gas such that the cavity is cooled by the cool gas purging the casing, the cavity being in communication with the attachment element.

10. A gas turbine system comprising:

a gas turbine comprising: a turbine blade stage; an outer shroud configured to circumferentially surround the turbine blade stage; and an inner shroud configured to circumferentially surround the turbine blade stage to seal with the turbine blade stage and comprising an attachment element configured to be inserted into the outer shroud to couple the inner shroud to the outer shroud, the inner shroud defining a void internal to the inner shroud;

a load coupled to the gas turbine;

a casing configured to be coupled to the outer shroud and to at least partially enclose the gas turbine; and one or more cavities formed by the outer shroud and the inner shroud, the one or more cavities being in fluid communication with a purge gas supply attached to the casing such that the purge gas purges an interior of the casing with a cool gas;

wherein the one or more cavities are cooled by the cool gas purging the casing, the cavities being in communication with the attachment element.

11. The system according to claim 10, wherein the load is an electric generator.

* * * * *

UNITED STATES PATENT AND TRADEMARK OFFICE

CERTIFICATE OF CORRECTION

PATENT NO. : 8,998,565 B2
APPLICATION NO. : 13/088635
DATED : April 7, 2015
INVENTOR(S) : Foster et al.

It is certified that error appears in the above-identified patent and that said Letters Patent is hereby corrected as shown below:

In the Specification

In Column 3, Line 65, delete “deforming” and insert -- deforming. --, therefor.

In the Claims

In Column 5, Line 9, in Claim 7, delete “stage:,” and insert -- stage; --, therefor.

In Column 5, Line 36, in Claim 8, delete “stage:,” and insert -- stage; --, therefor.

Signed and Sealed this
Twenty-second Day of September, 2015

Michelle K. Lee

Michelle K. Lee
*Director of the United States Patent and Trademark Office*